US006405384B1

(12) United States Patent
Chiang

(10) Patent No.: US 6,405,384 B1
(45) Date of Patent: Jun. 18, 2002

(54) SWIMMING GOGGLES

(76) Inventor: Herman Chiang, 11L-2 NoG34-9 Ching-Ping Rd., Chung-Ho City Taipei Hsien (TW)

( * ) Notice: Subject to any disclaimer, the term of this patent is extended or adjusted under 35 U.S.C. 154(b) by 0 days.

(21) Appl. No.: 09/813,602

(22) Filed: Mar. 20, 2001

(51) Int. Cl.[7] ..... A61F 9/02
(52) U.S. Cl. ..... 2/428; 351/43
(58) Field of Search ..... 2/428, 430, 440, 2/443, 441, 426; 351/43, 90, 92

(56) References Cited

U.S. PATENT DOCUMENTS 4,279,040 A * 7/1981 Garofalo ..... 2/428
5,423,092 A * 6/1995 Kawai ..... 2/441
5,815,235 A * 9/1998 Runckel ..... 351/92
5,915,541 A * 6/1999 Beltrani ..... 2/430
6,276,794 B1 * 8/2001 Chiang ..... 2/426

* cited by examiner

*Primary Examiner*—Rodney M. Lindsey
(74) *Attorney, Agent, or Firm*—Pro-Techtor International Services

(57) ABSTRACT

The present invention discloses a swimming goggles comprising a lens frame which is assembled by a first frame and a second frame; a padding member and a lens which are assembled into the first frame and the second frame; and a head strap, characterized in that the lens and the padding member are fixed as a whole piece with press tightly by the first frame and the second frame, wherein a extending plate is respective disposed on the first fame and the second frame with a opening thereon, and each extending plate has a protrusion at the edge of the opening and the second frame have lugs which could press with the protrusions together tightly after the stressing element is assembled to the first frame and the second frame respectively. Such that providing better comfort without pressing hard on the wearer's eyeballs, and offering a wider vision for the wearer as well.

11 Claims, 5 Drawing Sheets

SWIMMING GOGGLES

BACKGROUND OF THE INVENTION

1. Field of the Invention

The present invention relates to a swimming goggles, more particularly, a swimming goggles of a novel structure have a large area of lens and cups the eye socket beyond, which gives better comfort and wider vision to the wearer after wearing.

2. Description of the Prior Art

The conventional swimming goggles designated for use in swimming pools have two lenses, each of which respectively cups the left and right eye sockets. In other words, the swimming goggles of the prior art cups the eye sockets by lens frame to prevent the seepage of water. Therefore the padding members are disposed on the lens frame no matter the foamed ones or the suckers are independently assembled to the left lens and the right lens. After such conventional swimming goggles is worn, the padding member has an adsorption around the eye sockets near the eyeballs. It is still comfortable after wearing for a short time, however the eyes will be very uncomfortable due to the pressure when wearing the goggles for some time, especially in diving. In addition, the vision of the conventional goggles is very difficult to reach wide angles due to the small area of the lens. As is well-known, enlarging the lens frame is the most direct method to improve the shortcomings of the narrow angle for the vision, but once the lens frame is enlarged, the whole structure of the swimming goggles will be changed, i.e. how to design a bridge in the lens frame? how to assemble an enlarging padding member to the whole structure of lens frame? and how to effectively fix an enlarging lens to the lens frame? etc., These are new issue that has to be solved.

SUMMARY OF THE INVENTION

Therefore, the primary objective of the present invention is to provide a swimming goggles that offers better comfort and wider vision to the wearer. The swimming goggles cups the eye socket beyond its area when wearing, allow both eyes are cupped in the same enclosed space, and we do not have to worry about the pressure acted on the eyeballs, and it further provides an air-tight waterproof effect.

The swimming goggles of the present invention mainly features that the lens and padding member of the goggles are fixed as a whole piece by the pressing of the lens frame, and such lens frame comprising a first frame and a second frame wherein between the first and second frames having a linkup means coupled to the upper and lower edges at the center of the first and second frames, and the frames has an inlaid groove for clipping the lens and the padding member. Further, a suppressing means is disposed at the lateral sides of the first and second frames respectively, in which each the suppressing means comprises an extending plate respectively disposed on the first frame and second frame; and a stressing element press tightly the first frame and second frame connection together. and provided the head strap of the swimming goggles to pass through. Hence the lens and the padding means can securely mount into the inlaid groove of the lens frame.

Further, according to the above features, wherein the linkup means comprises a latched groove on a first frame, and a latched post on a second frame, as well as a connection element coupling the latched groove and the latched post, such that the central section of the first frame and second frame can be latched together as a piece.

Further, according to the above features, wherein the extending plate of the first frame and second frame is respectively formed an opening which be located on the axis of the extending plate, moreover each extending plate has a protrusion at the edge of the opening; and each stressing element opposite the protrusions at the first frame and second frame have lugs which could press tightly both the protrusions together after the stressing element is assembled to the first frame and the second frame respectively. In addition, There is a passing through area at the stressing element allow the head strap of swimming goggles to revolve and pass through.

To make it easier for our examiner to understand the objective of the invention, structure, innovative features, and performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DESCRIPTION OF THE PREFERRED EMBODIMENT

Figure 1:
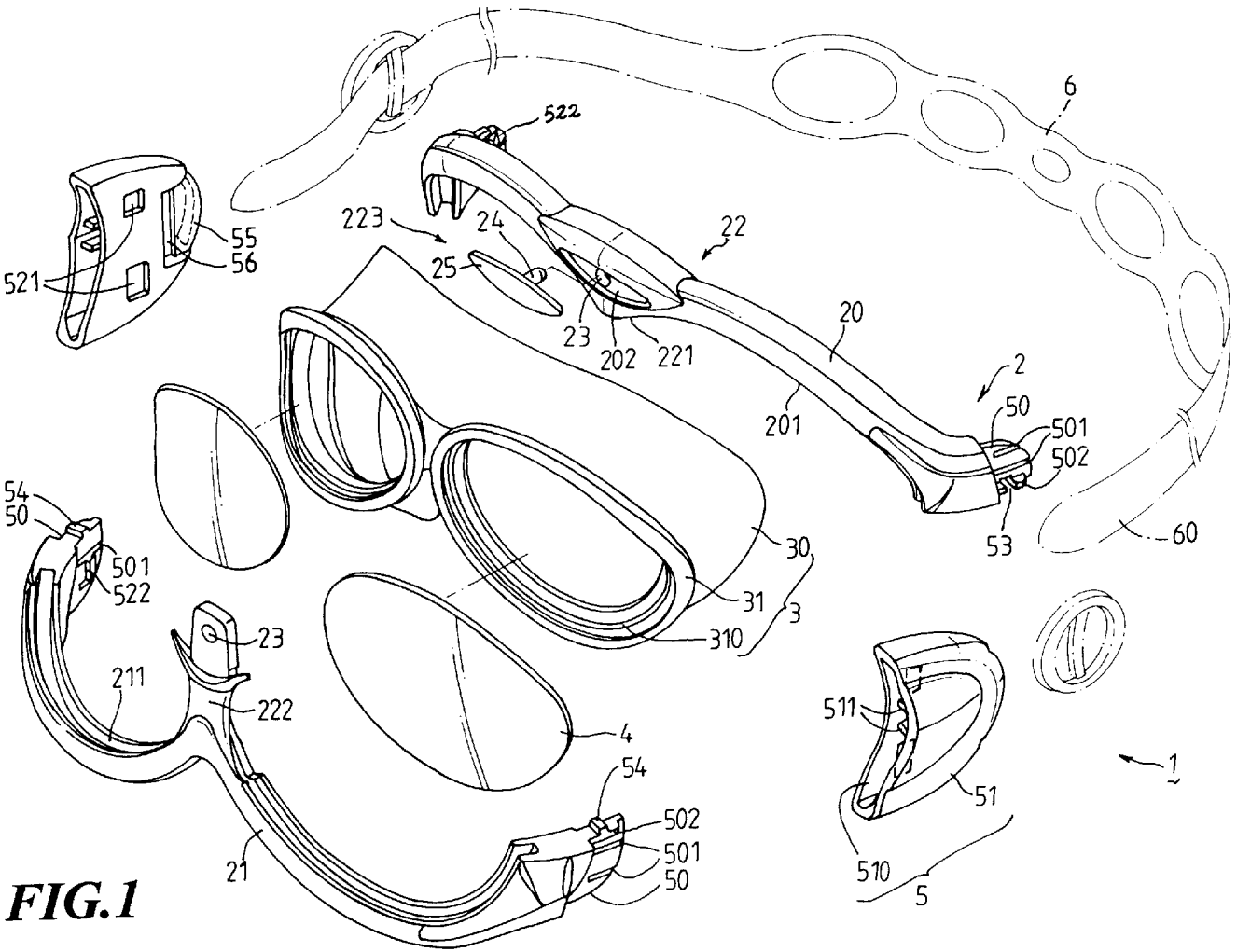
FIG. 1 shows a three-dimensional diagram of the disassembled parts of the swimming goggles of the present invention.

Please refer to FIG. 1, the swimming goggles comprises a lens frame 2, a padding member 3, a lens 4, a suppressing means 5, and a head strap device 6, wherein the lens frame 2 is formed by tightly assembling a first frame 20 and a corresponding second frame 21. The upper edge and the lower edge at the central section of both the first and second frames 20–21 are coupled to form an unit and the lens frame 2 is divided into two parts by a linkup means 22 An inlaid portion 201, 211 is disposed each on the inner rim of both the first frame and second frame 20–21 for retaining the lens 4 and the padding member 3. The linkup means 22 comprises a latched groove 221 and a latched post 222 as well as a connection element 223, in which the latched groove 221 being disposed on the first frame 20 and the latched post 222 being extended from the second frame 21 with a end which could be assembled into the latched groove 221 such that the latched groove 221 and the latched post 222 can latch the middle section of the first frame 20 and that of the second frame 21 together as a piece, and the linkup means 20 separates the lens frame 2 into the left and right portion. Moreover the connection element comprises a hole 23, a pin 24, and a base plate 25, wherein the hole 23 is disposed on the first frame 20 and the latched post 222 which corresponded with each other. The pin 24 is formed the middle of the base plate 25 and pass through the hole 23 during assembled into the first frame 20 and the latched post 222. The base plate 25 is received a dimpling 202 which located on the first frame 20 for ensure securely and effectively assembly.

The padding member 3, having a face fitting part 30 and a lens retaining part 31, of which the face fitting part is of large area and its upper edge attaches the upper portion of the eyebrow, and the lower edge attaches the lower portion of the eye socket of the wearer. The lens retaining portion 31 forms a receiving hole on the padding member 3 in correspondence to the size of the lens. The periphery of the receiving hole has a recess 310 for covering the periphery of the lens 4 and being accommodated in the inlaid groove 201–211 of the lens frame 2.

Figure 5:
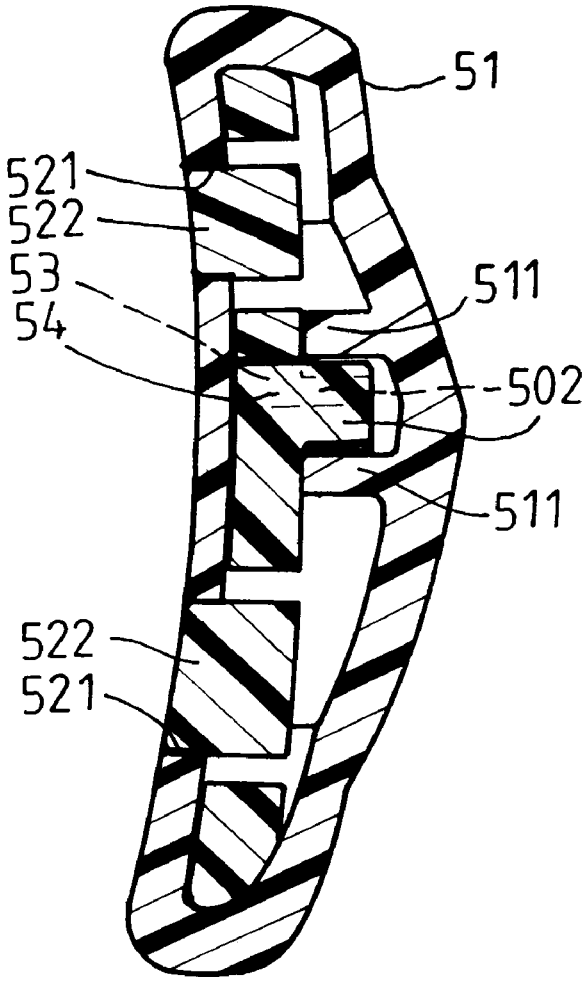
FIG. 5 is the cross-sectional diagram of the A—A section of FIG. 4.

Furthermore, a suppressing means 5 is disposed on each of the lateral sides of the lens frame 2, the suppressing means 5 comprises an extending plate 50 and a stressing element 51, wherein the extending plate 50 extend each the lateral said of the first frame and the second frame respectively, The opening 501 disposed on the extending plate 50 which provided appropriateness resiliency when the extending plate 50 is pressed in force. Further each extending plate 50 has a protrusion 502 at the edge of the opening 501. Each stressing element 51 has socket 510 for receiving the extending plate 50 of the first frame 20 and the second frame 21, The lugs 511 are disposed on the stressing element 51 opposite the protrusions 502 at the first frame 20 and the second frame 21 which could press tightly both the protrusions 502 together after the stressing element 51 is respectively assembled to the first frame 20 and the second frame 21 (see FIG. 5) so as to pressing the first frame 20 and the second frame 21 connection together tightly. In addition, between the extending plate 50 of the first frame 20 and the extending plate 50 of the second frame 21 have a positioning slot 53 and a positioning post 54 with mating each other. It could be provided the first frame 20 and the second frame 21 assemble securely. Then between the stressing element 51 and the extending plate 50 of the first frame 20 and second frame 21 have a slots 521 and a wedge element 522 with mating each other. Wherein the slots 521 is generally square in shape which is disposed on near the side of the stressing element 51. The wedge element 522 is generally conical in shape which is disposed on opposite the side of the slots 521 at the extending plate 50 also there is a passing through area near the socket 510 at the stressing element 51 which include a mouthing 55 for leading the head strap 60, and a rod 56 for bridging the mouthing 55 allowing the head strap of swimming goggles to revolve and pass through.

Figure 2:
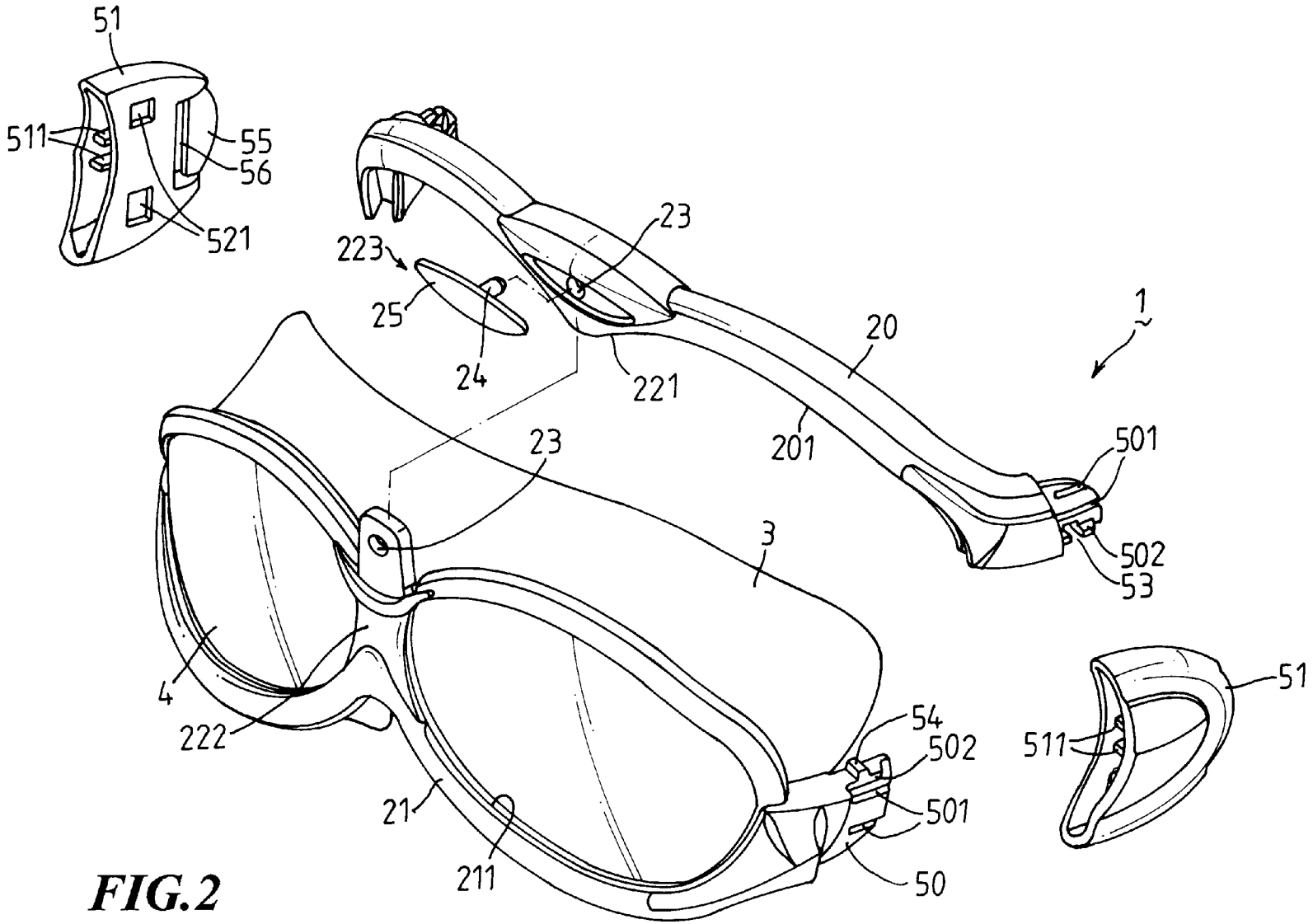
FIG. 2, FIG. 3, and FIG. 4 show the three-dimensional diagrams of a series of step-by-step assembly process of the swimming goggles according to the present invention.
Figure 3:
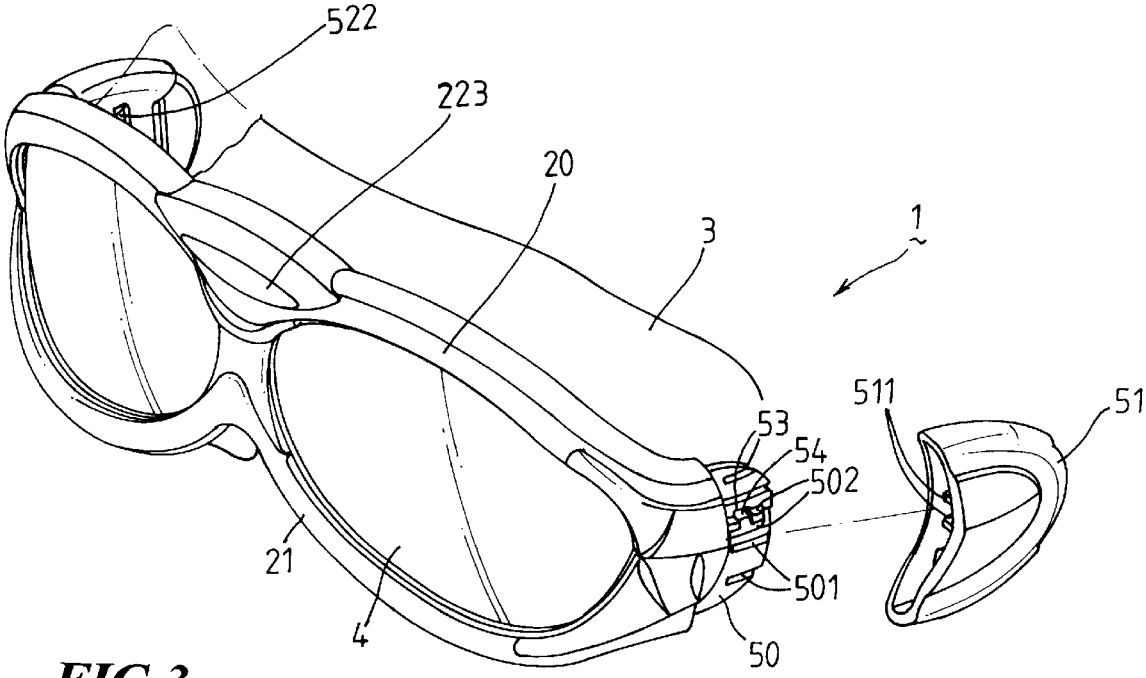
Figure 4:
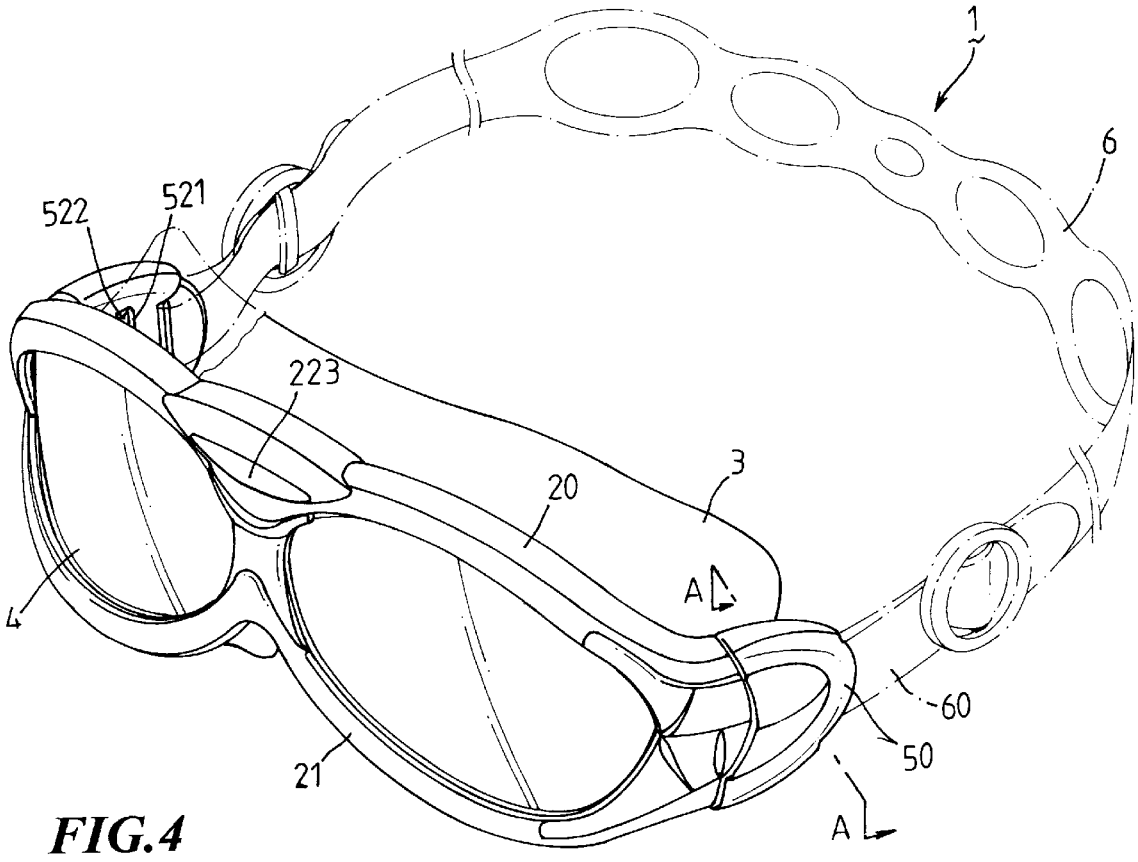

Please continue to refer to FIGS. 2 to 4, which illustrate the three-dimensional diagrams of a series of assembling steps. Firstly, install the lens 4 into the recess 310 of the lens retaining portion 31 of the padding member 3, and then install it into the inlaid groove 211 of the second frame 21 as shown in FIG. 2. Later the latched post 222 on the second frame 21 by the first frame 20 into the latched groove 221 (please refer to FIG. 2), and couple to the first frame 20 and the second frame 21 together, further passing through the hole 23 of the first frame 20 and latched post 222 by the pin 24 of the connection element 223, so as to the base plate 25 is received into the dimpling 202, and can securely couple to the central portion of the first frame 20 and the second frame 21. Then, refer to FIG. 5 the protrusion 502 of the extending plate 50 is received the lug 511 of the stressing element 51 by press tightly in force during the stressing element 51 respectively install into the extending plate 50 of the first frame 20 and second frame 21, so that more press tightly the first frame 20 and the second frame 21 together. In the meantime, the slots 521, the wedge element 522 and the position slot 53, the position post 54 mating each other, It will securely couple to the stressing element 51, the extending plate 50 of the first frame 20, and second frame 21. Finally, each of both ends of a head strap 60 of a head strap device 6 respectively passes through around the mouthing 55 of the stressing element 51 and pass through the rod 56, such that all assemble process finished.

Therefore, in summation of the above description, the present invention obviously attains the objective of the present invention. The inventor of the present invention based on years of experience in the related industry conducted extensive research to enhance the structure of the present invention herein which is hereby submitted for patent application. While the invention has been described in what is considered the most practical and preferred embodiments, it is understood that the invention is not limited to the disclosed embodiments, but is intended to cover various modifications and similar arrangements and procedures within the spirit and scope of the broadest interpretation and equivalent arrangements, modifications, and procedures.

Numbering of the Major Elements

| | | | |
|---|---|---|---|
| Swimming goggles | 1 | | |
| Lens frame | 2 | | |
| First frame | 20 | Second frame | 21 |
| Linkup means | 22 | Hole | 23 |
| Pin | 24 | Base plate | 25 |
| Inlaid groove | 201–211 | | |
| Dimpling | 202 | Latched groove | 221 |
| Latched post | 222 | Connection element | 223 |
| Padding member | 3 | | |
| Face fitting portion | 30 | Lens retaining portion | 31 |
| Recess | 310 | | |
| Lens | 4 | | |
| Suppressing means | 5 | | |
| extending plate | 50 | stressing element | 51 |
| opening | 501 | protrusion | 502 |
| socket | 510 | lug | 511 |
| slot | 521 | wedge element | 522 |
| positioning slot | 53 | positioning port | 54 |
| mouthing | 55 | rod | 56 |
| Head strap device | 6 | Head strap | 60 |

what is claimed is:

1. A swimming goggles, comprising:

a lens frame, having a first frame and a second frame which is assembled by facing from upper to lower in the direction, wherein an inlaid groove being disposed at the internal rim of the first frame and the second frame, a linkup means disposed at the center of the first frame and the second frame, and a suppressing means being disposed at the lateral sides of the first frame and the second frame, and said suppressing means comprising extending plates respectively disposed on the first frame and the second frame; and a stressing element pressing the first frame and the second frame together tightly and provided a mouthing for a head strap of the swimming goggles to pass through a padding member, comprising a face fitting part and a lens retaining part;

a lens, for being retained in the lens retaining part of the padding member and being accommodated in the inlaid groove of the first frame and the second frame altogether; and a head strap device, comprising a head strap being disposed at the lateral sides of the lens frame.

2. A swimming goggles according to claim 1, wherein the linkup means comprising: a latched groove on the first frame, and a latched post on the second frame, as well as a connection element coupling the latched groove and the latched post, such that the central section of the first frame and the second frame can be latched together as a whole piece.

3. A swimming goggles according to claim 2, wherein the extending plates of the first frame and second frame is respectively formed an opening which be located on the axis of the extending plates, moreover each extending plate has a protrusion at the edge of the opening.

4. A swimming goggles according to claim 3, wherein each stressing element has socket for receiving the extending plate of the first frame and second frame, also the socket opposite the protrusions of the first frame and second frame have lugs which could press with the protrusions together tightly after the stressing element is assembled to the first frame and the second frame respectively.

5. A swimming goggles according to claim 4, wherein between the stressing element and the extending plate of the first frame and second frame have slots and a wedge element with mating each other.

6. A swimming goggles according to claim 2, wherein the connection element comprises a hole, a pin, and a base plate, wherein the hole is disposed on the first frame and the latched post which corresponded with each other; the pin is formed the middle of the base plate and pass through the hole during assembled into the first frame and the latched post.

7. A swimming goggles according to claim 5, wherein the first frame has a dimpling around the hole of the first frame for receiving the base plate which is provided the connection element with secure assembly.

8. A swimming goggles according to claim 5, wherein the face fitting part of said padding member attaches the upper portion of the eyebrow and the lower portion of the eye socket of the wearer.

9. A swimming goggles according to claim 5, wherein the slots are generally square in shape which being disposed on the side of the suppressing element toward the lens; and the wedge element is generally conical in shape which being disposed on the side of the extending plates opposition the slots.

10. A swimming goggles according to claim 9, wherein a passing through area of the head strap is disposed on the same side of the slots of the suppressing element, including the mouthing for passing through and a rod which bridging the mouthing.

11. A swimming goggles according to claim 1, wherein between the extending plate of the first frame and the extending plate of the second frame having a positioning slot and a positioning post which can provide secure steadiness to the first frame and the second frame without transversal movement.

* * * * *